US007150641B2

(12) United States Patent
Tsai

(10) Patent No.: US 7,150,641 B2
(45) Date of Patent: Dec. 19, 2006

(54) ELECTRICAL CONNECTION SOCKET STRUCTURE WITH A MOVABLE INSULATION BLOCK

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/265,070

(22) Filed: Nov. 1, 2005

(65) Prior Publication Data

US 2006/0105601 A1 May 18, 2006

(30) Foreign Application Priority Data

Nov. 15, 2004 (TW) ..... 93134950 A

(51) Int. Cl.
*H01R 29/00* (2006.01)

(52) U.S. Cl. ..... 439/188; 439/668

(58) Field of Classification Search ..... 439/188, 439/668

See application file for complete search history.

(56) References Cited

U.S. PATENT DOCUMENTS 6,062,885 A * 5/2000 White ..... 439/188
6,540,535 B1 * 4/2003 Zhu et al. ..... 439/188
6,651,693 B1 * 11/2003 Simmons et al. ..... 137/329.05
6,827,596 B1 * 12/2004 Hori ..... 439/188
6,835,080 B1 * 12/2004 Chang ..... 439/188

* cited by examiner

*Primary Examiner*—Truc Nguyen
(74) *Attorney, Agent, or Firm*—Pro-Techtor Int'l Services

(57) ABSTRACT

An electrical connection socket structure, into which a plug of a signal wire is inserted for electrical connection, includes a plastic base formed with a hole, a plurality of terminals disposed in the plastic base, and an insulation block disposed in the plastic base and formed with a contact slant. Each terminal has a pin and an elastic arm. The pin is located below the plastic base and the elastic arm has a contact. When the plug is inserted into the hole of the plastic base, the plug pushes the contact slant of the insulation block and thus moves the insulation block. At least two terminals among the plurality of terminals may be electrically connected to or disconnected from each other according to a displacement of the insulation block.

12 Claims, 14 Drawing Sheets

ELECTRICAL CONNECTION SOCKET STRUCTURE WITH A MOVABLE INSULATION BLOCK

BACKGROUND OF THE INVENTION

1. Field of the Invention

The invention relates in general to an electrical connector, and more particularly to an electrical connection socket structure to be connected to an inserted plug of a signal wire.

2. Description of the Related Art

A conventional electrical connector has to be connected to various different audio signal wires, such as those of a multi-channel speaker, an earphone, a microphone, and the like. So, the connector usually has multiple plugs to be connected to the above-mentioned apparatuses. However, each plug has to correspond to a signal wire of a specific apparatus and the connection fails if the plug is connected to the wrong signal wire.

In order to facilitate the usage of connection so that the user does not have to insert the plug into the correct hole, the manufacturer adds a switch device to the electrical connection socket structure. The switch device is triggered by the inserted plug of the signal wire, and a chipset on a motherboard is enabled to make a selection and a conversion so as to match with the type of the inserted plug. Thus, the user can build a connection without having to insert the plug into the correct hole.

Referring to FIG. 1, a conventional electrical connector includes a plastic base 10 and a plurality of switch devices. The plastic base 10 is formed with a plurality of holes 11 and a circumferential wall of the hole 11 is formed with a flange 12.

Each switch device corresponds to each hole and includes a first terminal 13 and a second terminal 20. The first terminal 13 includes an elastic arm 14 and an extension 15. The elastic arm 14 has one end fixed to the plastic base 10 and the other end formed with a plastic projection 18 by way of injection molding. The extension 15 with an inverse-L shape has a transversal portion 16 and a longitudinal portion 17. A distal end of the transversal portion 16 is also fixed to the plastic base 10 and in contact with the elastic arm 14. A distal end of the longitudinal portion 17 is formed with a pin protruding over the plastic base. The second terminal 20 has a longitudinal portion 21 and a contact sheet 22. The longitudinal portion 21, which is parallel to the longitudinal portion 17 of the first terminal 13, has a lower end formed with a pin protruding over the plastic base. The contact sheet 22 connected in perpendicular to an upper end of the longitudinal portion 21 corresponds to the elastic arm 14 of the first terminal 13 and is formed with a protruding contact point 23.

According to the above-mentioned structure, when a plug 25 for the signal wire is inserted for connection, the plug 25 pushes the plastic projection 18 to bend down the elastic arm 14 of the first terminal 13 and thus electrically connect the first terminal 13 to the second terminal 20. Thus, the plug 25 for the signal wire is separated from the first terminal 13 through the plastic projection 18 even if the switch device is ON, such that the plug 25 still can be normally electrically connected to signal terminals (not shown).

The prior art structure has the following drawbacks.

1. The structure is manufactured by injection molding the plastic projection 18 on the first terminal, so the manufacturing processes are complicated and are not easy, and the throughput is low. Thus, the cost is increased because the metal terminal has to be put in the mold followed by the injection molding.

2. Because it is very difficult to directly mold the plastic projection 18 on the whole first terminal 13 by way of injection molding, the first terminal 13 has to be cut into the elastic arm 14 and the extension 15. Then, the plastic projection 18 is formed on the shorter elastic arm 14. Although the difficulty of injection molding can be reduced, the two members of the first terminal have to be assembled together. So, the manufacturing cost is increased.

SUMMARY OF THE INVENTION

It is therefore an object of the invention to provide an electrical connection socket structure, which may be manufactured easily with a reduced manufacturing cost.

Another object of the invention is to provide an electrical connection socket structure having an insulation block formed with a blocking member for shielding a contact of a terminal and preventing the contact from exposing to the air and oxidizing. When the insulation block is moved, the insulation block rubs against the contact of the terminal and thus removes an oxidation layer.

The invention achieves the above-identified objects by providing an electrical connection socket structure, into which a plug of a signal wire is inserted for electrical connection. The structure includes a plastic base formed with a hole, a plurality of terminals disposed in the plastic base, and an insulation block disposed in the plastic base and formed with a contact slant. Each terminal has a pin and an elastic arm. The pin is located below the plastic base and the elastic arm has a contact. When the plug is inserted into the hole of the plastic base, the plug pushes the contact slant of the insulation block and thus moves the insulation block. At least two terminals among the plurality of terminals may be electrically connected to or disconnected from each other according to a displacement of the insulation block.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
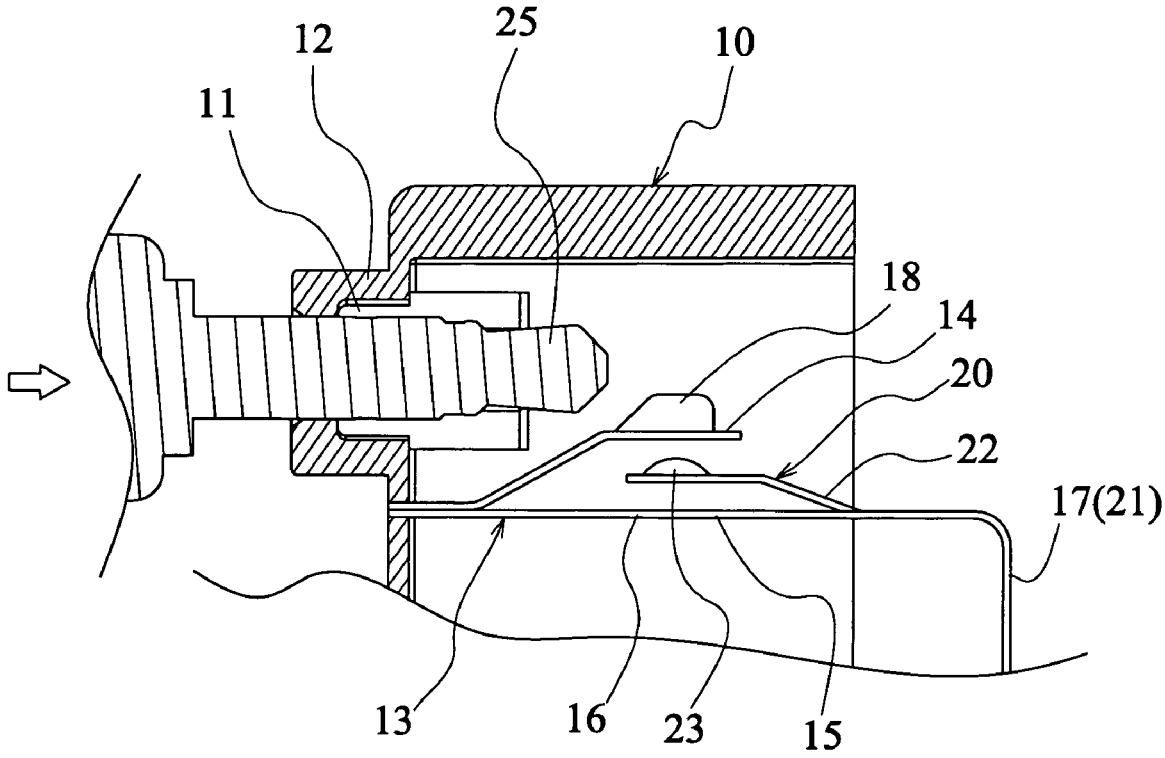
FIG. 1 (Prior Art)
FIG. 1 is a schematically cross-sectional view showing a conventional electrical connector.
Figure 3:
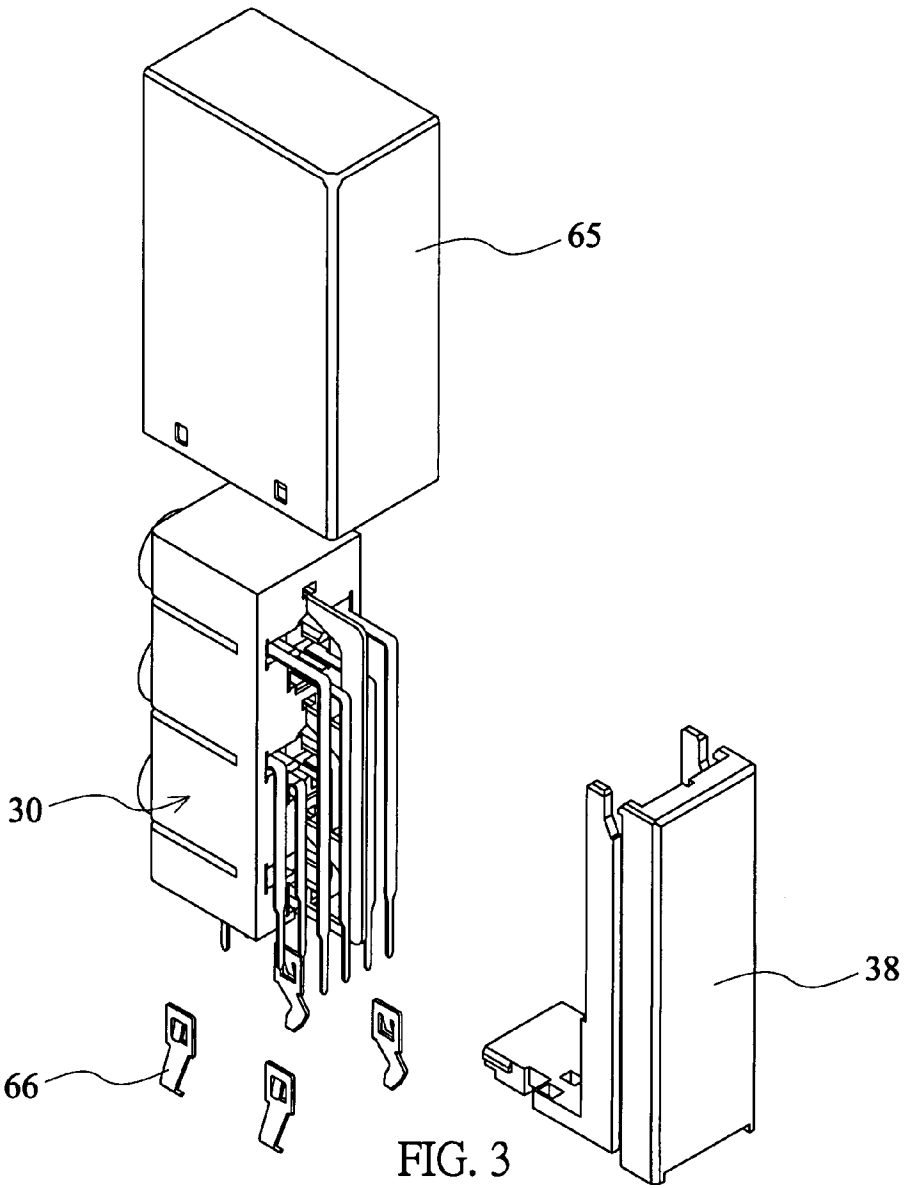
FIG. 3 is a pictorially exploded view showing the first embodiment of the invention.
Figure 2:
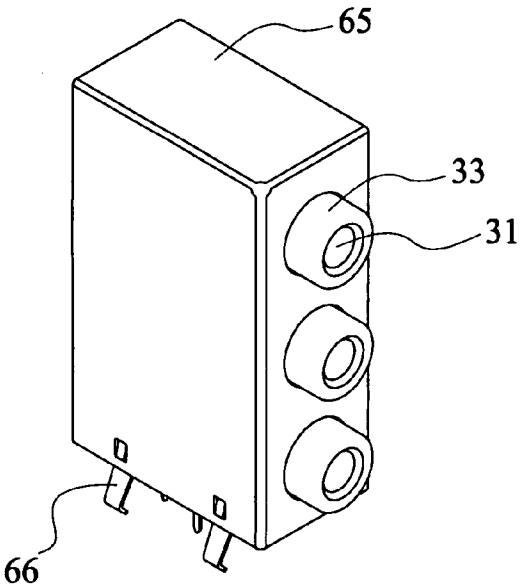
FIG. 2 is a pictorial view showing a first embodiment of the invention.
Figure 4:
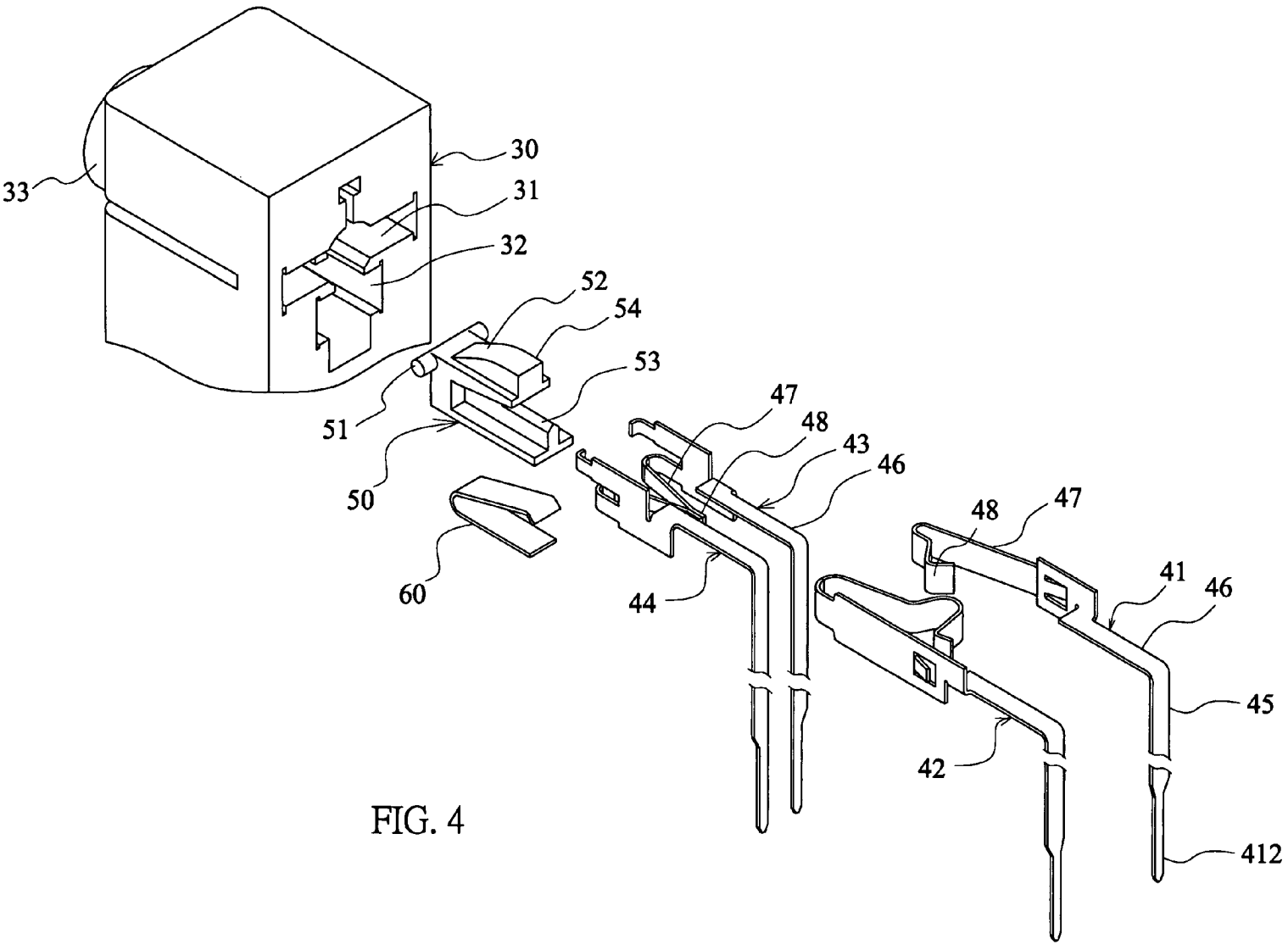
FIG. 4 is a pictorially exploded view showing the first embodiment of the invention.
Figure 5:
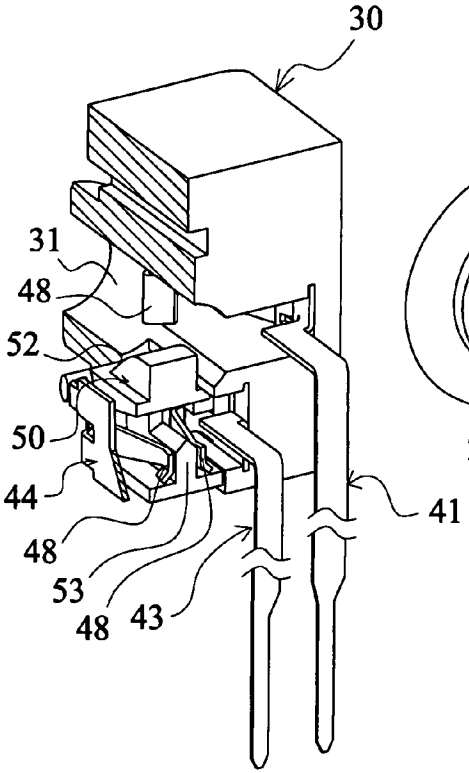
FIG. 5 is a pictorially assembled view showing the first embodiment of the invention.

Referring to FIGS. 2 and 3, this embodiment has three holes and includes a plastic base 30, a plastic rear seat 38 and a metal housing 65. The plastic base 30 includes three electrical connection socket structures arranged in a vertical direction. The plastic rear seat 38 having an L-shape covers a rear end and a lower end of the plastic base 30. The metal housing 65 covers the plastic base 30 and the plastic rear seat 38. Four hooks 66 for fixing the metal housing 65 to a circuit board are disposed at the lower end of the metal housing 65. As shown in FIGS. 4 and 5, each electrical connection socket structure includes a plastic base 30, four terminals, an insulation body 50, and an elastic member 60.

The plastic base 30 is formed with a hole 31 and a chamber 32. The hole 31 has a circumferential wall protruding frontward to form a flange 33. The chamber 32 is located below the hole 31 and communicates with the hole 31.

The four terminals are disposed in the plastic base 30 and include a first terminal 41 and a second terminal 42 electrically connected to a signal wire, and a third terminal 43 and a fourth terminal 44 which form a switch device. Each terminal has a longitudinal portion 45 and a transversal portion 46 perpendicular to each other. The longitudinal portion 45 has a lower end formed with a longitudinal pin 412 extending out of the lower end of the plastic base. The transversal portion 46 extends into the plastic base 30 to form an elastic arm 47. The elastic arm 47 has a contact 48. The plate faces of the elastic arms 47 of the first and second terminals 41 and 42 are longitudinal and disposed at two sides of the hole 31. The plate faces of the elastic arms 47 of the third and fourth terminals 43 and 44 are longitudinal and located in the chamber 32, and the contacts 48 of the third and fourth terminals 43 and 44 can be moved laterally and elastically contact each other. The lower end of the each of the terminals 43 and 44 are formed with a chamfer 49 (FIG. 7) to facilitate the entrance of the contact.

The insulation block 50 has one end formed with a pivot 51 pivoted on the sidewall of the chamber 32 of the plastic base 30. The insulation block 50 has a ⊏shape. A top board of the insulation block 50 is formed with a projection 54 having a contact slant 52. A bottom board of the insulation block 50 is formed with a longitudinal blocking member 53. An upper end of the blocking member 53 is formed into a tip.

The elastic member 60 disposed in the plastic base 30 rests against the lower end of the insulation block 50 to provide a restoring force after the insulation block 50 is pressed.

Figure 6:
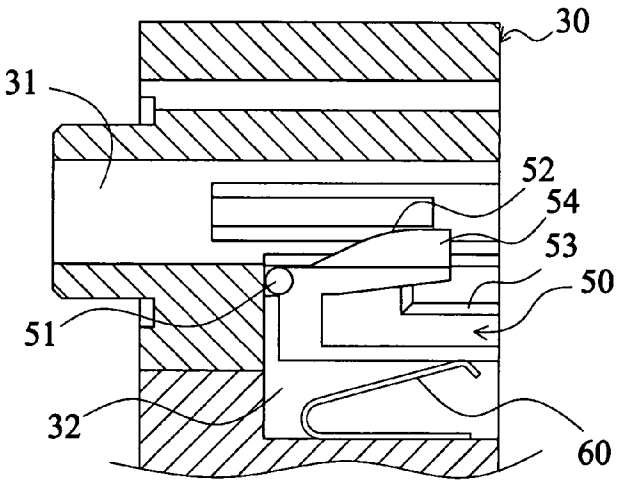
FIG. 6 is an assembled cross-sectional view showing the first embodiment of the invention.

As shown in FIGS. 5 and 6, when the single plug for a wire is not inserted into the hole 31, the insulation block 50 is pushed by the resilience of the elastic member 60 and located at the upper bound position. So, the contact slant 52 protrudes into the hole 31 and the blocking member 53 separates the contact 48 of the third terminal 43 from the contact 48 of the fourth terminal 44. At this time, the contacts of the third and fourth terminals 43 and 44 clamp the blocking member 53, and are thus free from oxidation due to the exposure to the air.

Figure 8:
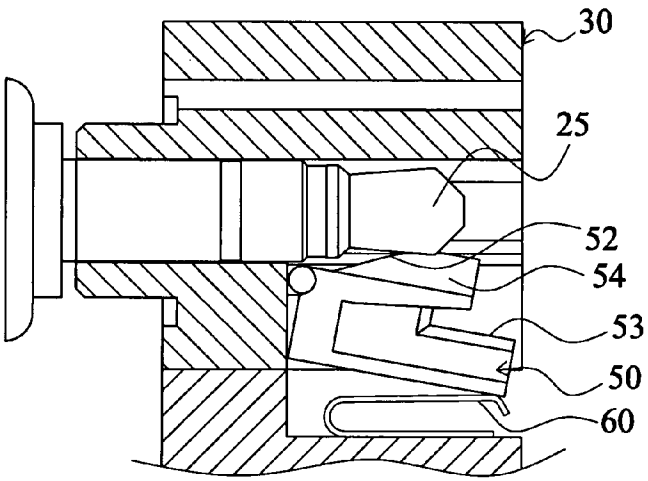
FIG. 8 is a cross-sectional view showing the usage state according to the first embodiment of the invention.
Figure 7:
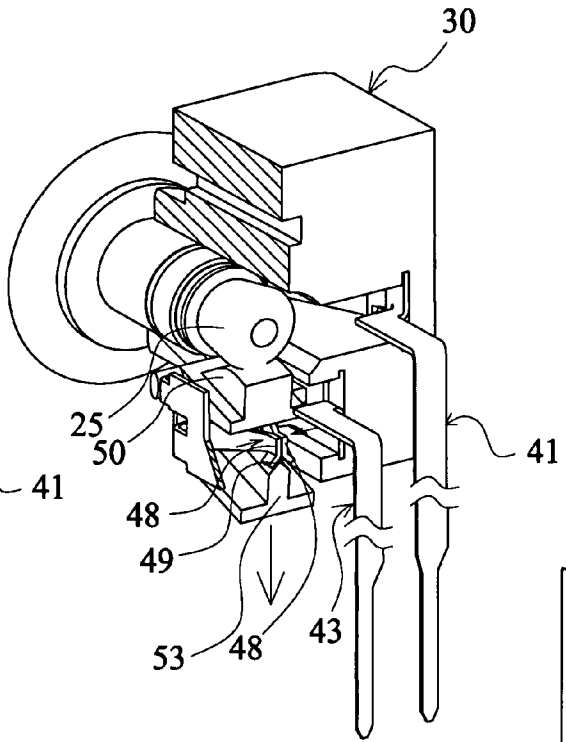
FIG. 7 is a pictorial view showing the usage state according to the first embodiment of the invention.

As shown in FIGS. 7 and 8, when the plug 25 for the signal wire is inserted into the hole 31, the plug 25 is electrically connected to the contacts 48 of the terminals 41 and 42 while pushing the contact slant 52 of the insulation block 50, such that the insulation block 50 is gradually moved downward to make the blocking member 53 separate from the contacts 48 of the terminals 43 and 44. Thus, the contacts 48 of the terminals 43 and 44 elastically contact each other to form the electrical connection. At this time, because the blocking member 53 can rub against the contact 48 of the terminal when the insulation block 50 is moved, the effect of removing the oxidation layer can be achieved.

Figure 9:
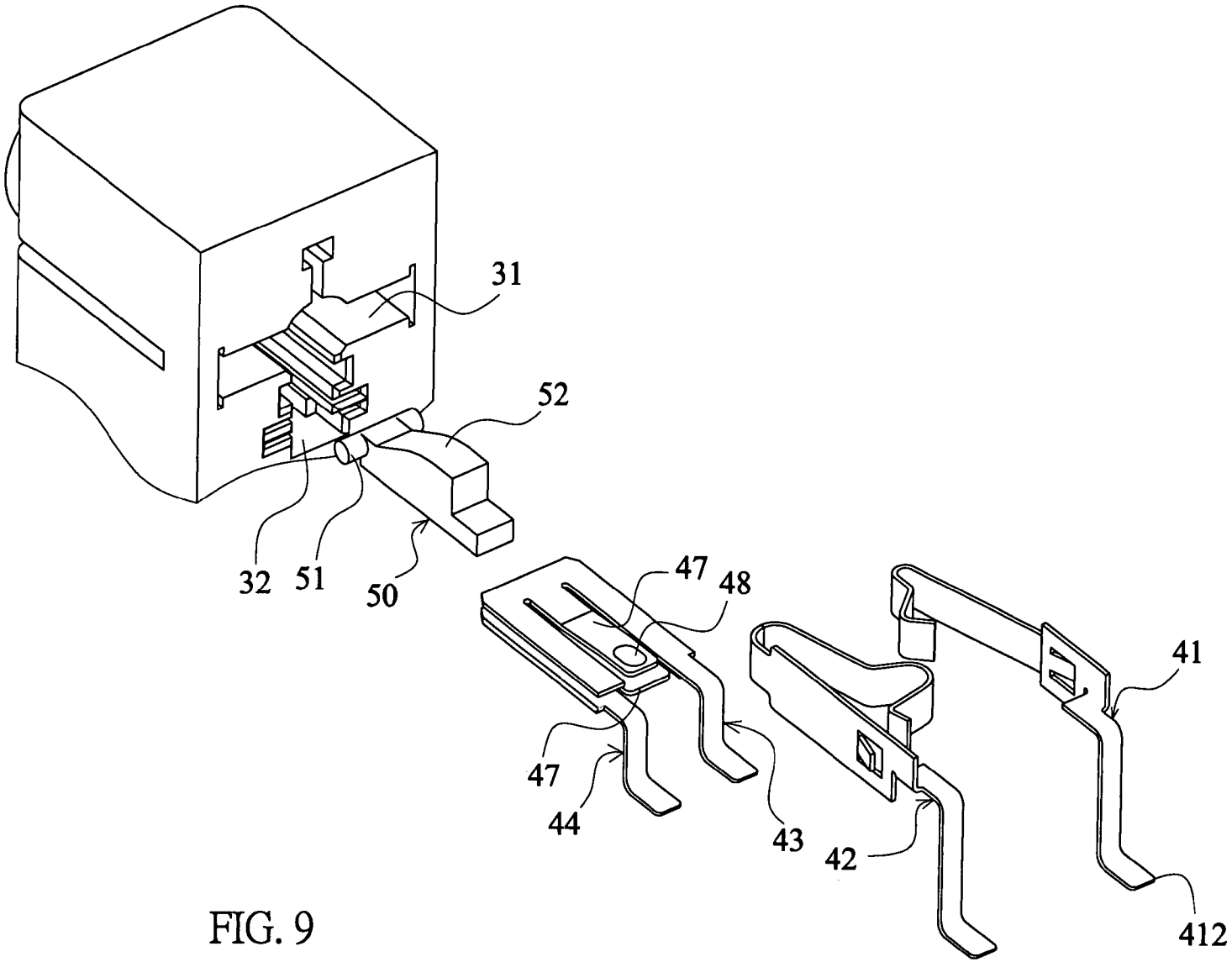
FIG. 9 is a pictorially exploded view showing a second embodiment of the invention.
Figure 10:
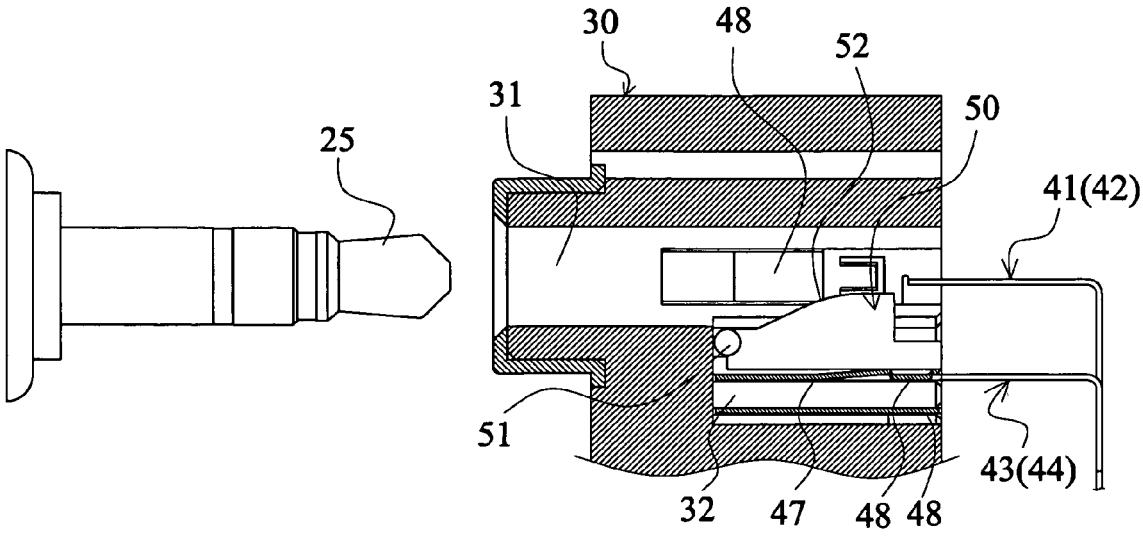
FIG. 10 is an assembled cross-sectional view showing the second embodiment of the invention.

As shown in FIGS. 9 and 10, the second embodiment is almost the same as the first embodiment except that the second embodiment has only one hole. The plate faces of the elastic arms 47 of the third and fourth terminals 43 and 44 are horizontal and located in the chamber 32 with a gap formed therebetween. The elastic arm 47 of the third terminal 43 is located above the elastic arm 47 of the fourth terminal 44. The pin 412 of each terminal is horizontal. One end of the insulation block 50 is formed with a pivot 51 and only one contact slant 52. The pivot 51 is pivoted on the side of the chamber 32 of the plastic base 30 and then directly rests against the elastic arm 47 of the third terminal 43. The resilience of the elastic arm 47 of the third terminal 43 provides the restoring force after the insulation block 50 is pressed to move.

Figure 11:
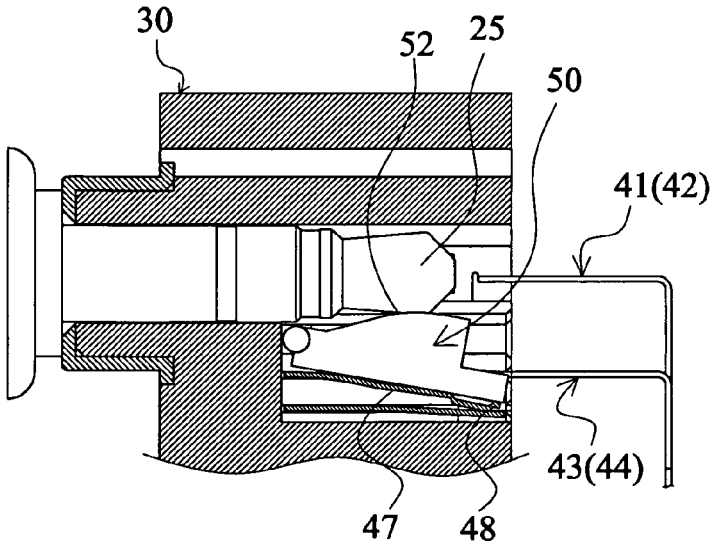
FIG. 11 is a cross-sectional view showing the usage state according to the second embodiment of the invention.

As shown in FIG. 11, when the plug 25 for the signal wire is inserted into the hole 31, the plug 25 is electrically connected to the contacts 48 of the first and second terminals 41 and 42 while pushing the contact slant 52 of the insulation block 50 such that the insulation block 50 is moved downward to press the elastic arm 47 of the third terminal 43. Thus, the contacts 48 of the third and fourth terminals 43 and 44 are electrically connected to each other.

Figure 12:
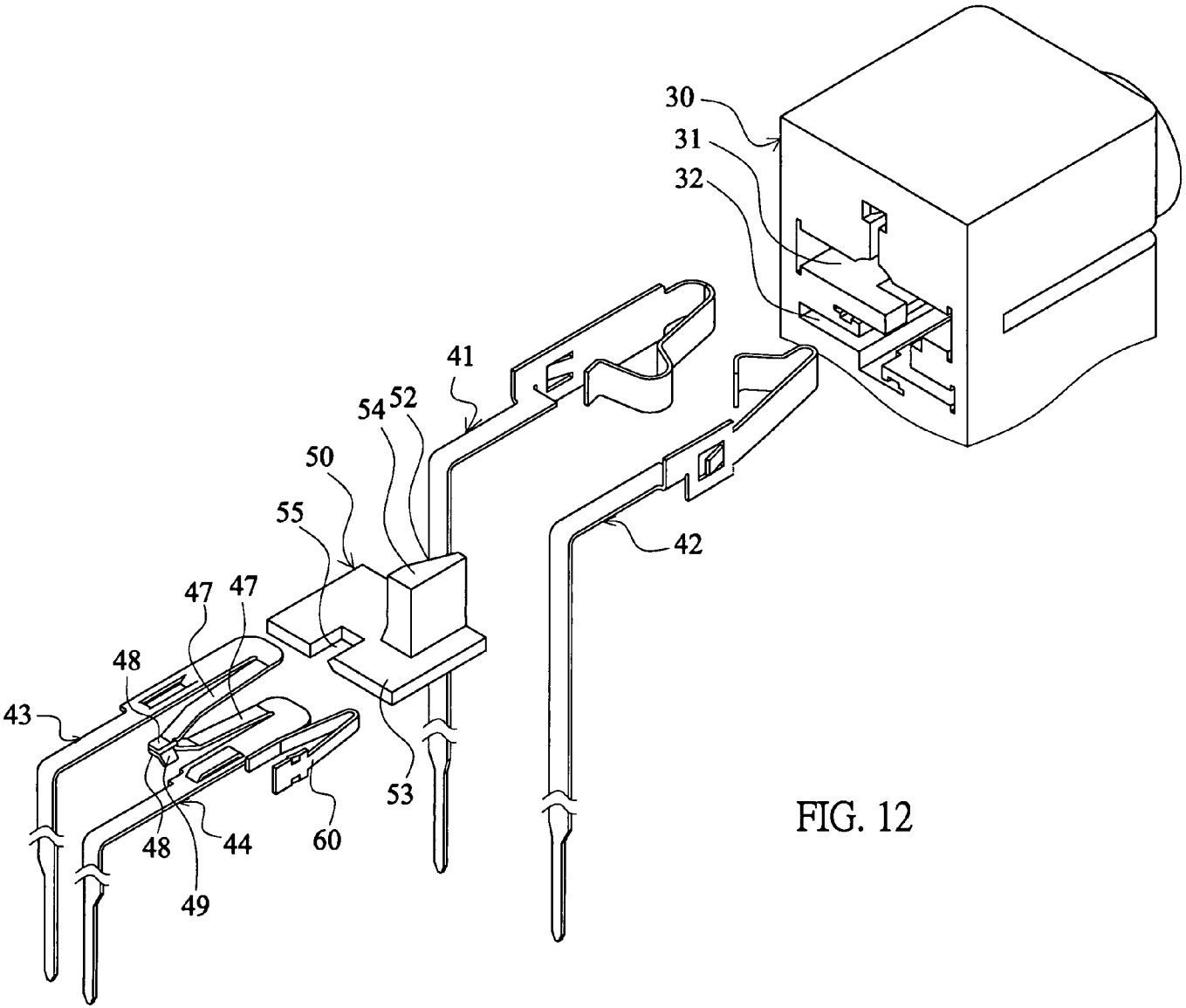
FIG. 12 is a pictorially exploded view showing a third embodiment of the invention.
Figure 13:
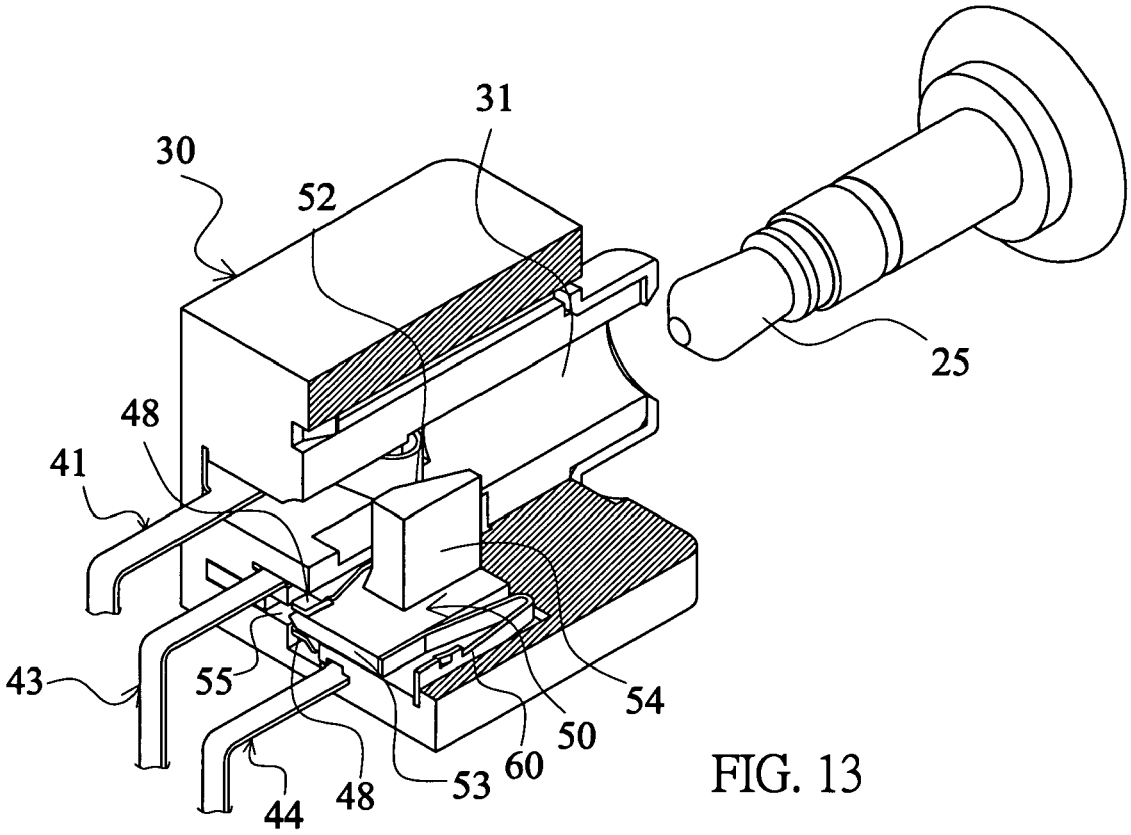
FIG. 13 is a pictorially assembled view showing the third embodiment of the invention.

As shown in FIGS. 12 and 13, the third embodiment is almost the same as the first embodiment except that the plate faces of the elastic arms 47 of the third and fourth terminals 43 and 44 are horizontal and the contacts 48 of the third and fourth terminals 43 and 44 are moved in a vertical direction and elastically contact each other. One side of each of the terminals 43 and 44 is formed with a chamfer 49 to facilitate the entrance of the contact. The insulation block 50 may be moved laterally in the plastic base and has a horizontal blocking member 53 and a longitudinal projection 54. The blocking member 53 is disposed in the chamber 32 and can be clamped between the contacts 48 of the third and fourth terminals 43 and 44. The insulation block 50 is formed with a notch 55. The projection 54 extends into the hole 31 and is formed with a contact slant 52 at one side thereof.

Figure 14:
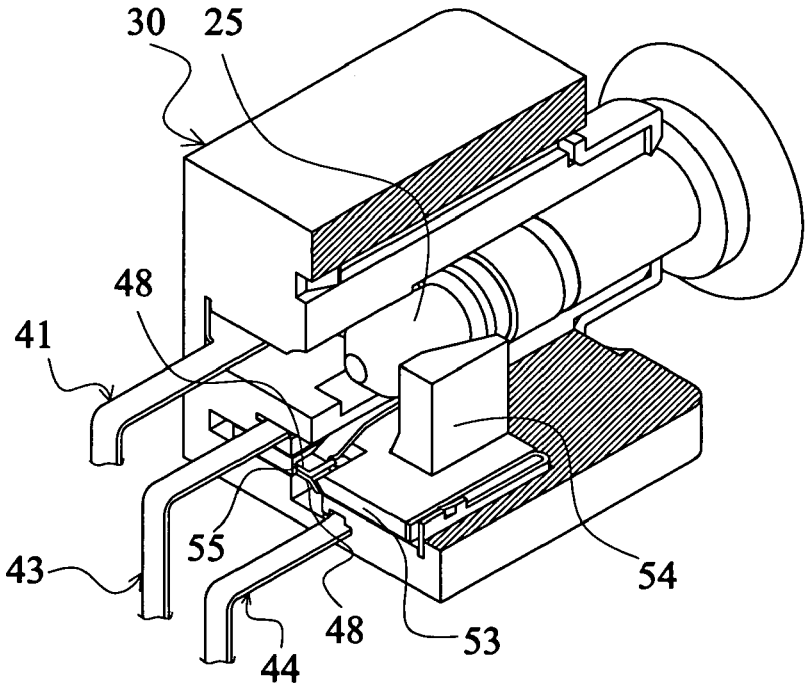
FIG. 14 is a pictorial view showing the usage state according to the third embodiment of the invention.

As shown in FIG. 14, when the plug 25 for the signal wire is inserted into the hole 31, the plug 25 is electrically connected to the contacts 48 of the first and second terminals 41 and 42 while pushing the contact slant 52 of the insulation block 50, such that the insulation block 50 is moved toward a side. Then, the blocking member 53 escapes from the contacts 48 of the third and fourth terminals 43 and 44 such that the contacts 48 of the third and fourth terminals 43 and 44 are electrically connected to each other. When the plug 25 for the signal wire is pulled out of the hole 31, the insulation block 50 is moved laterally by the restoring force provided by the elastic member 60 and then recovers to the original state of FIG. 13.

Figure 15:
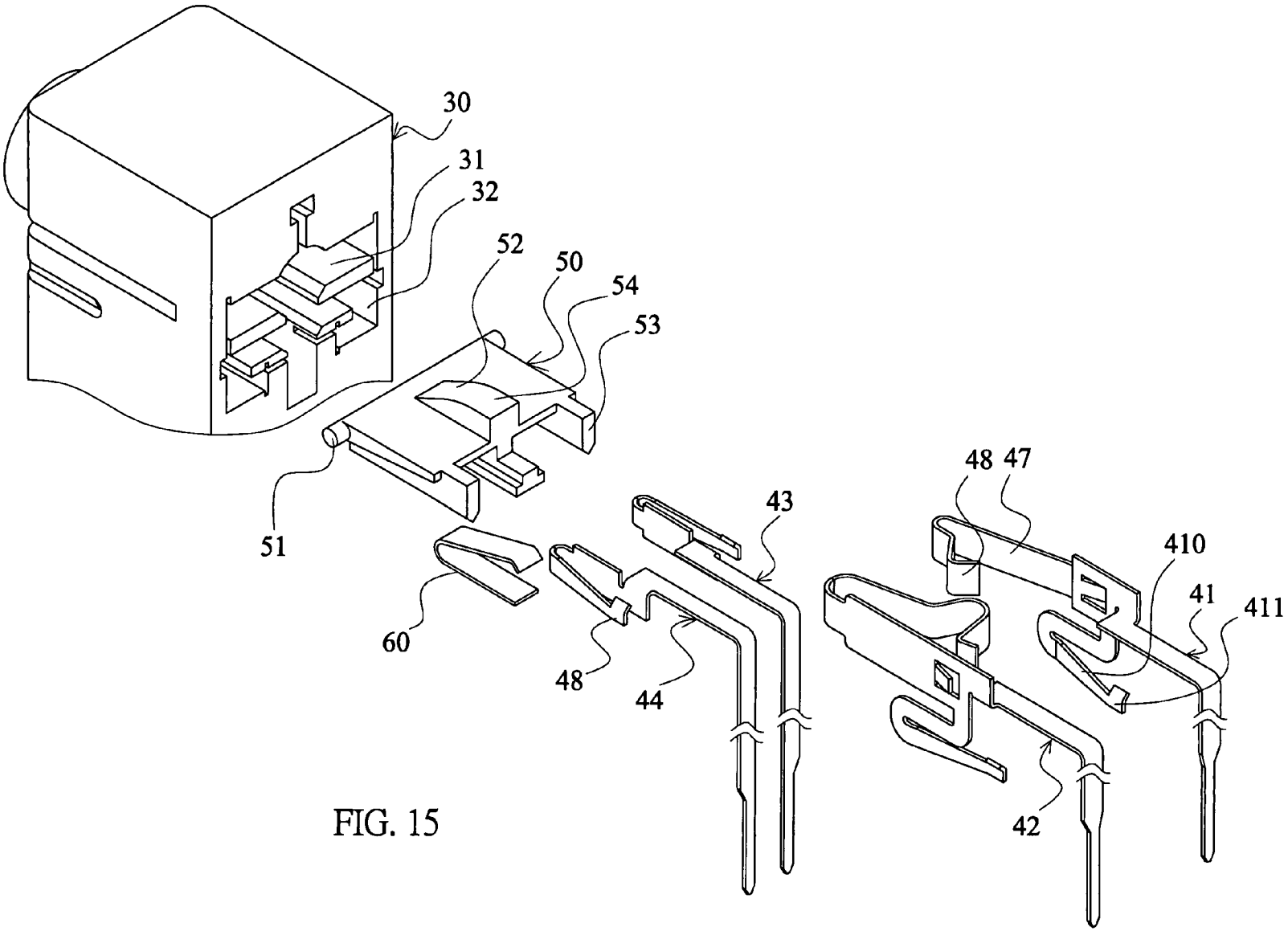
FIG. 15 is a pictorially exploded view showing a fourth embodiment of the invention.
Figure 16:
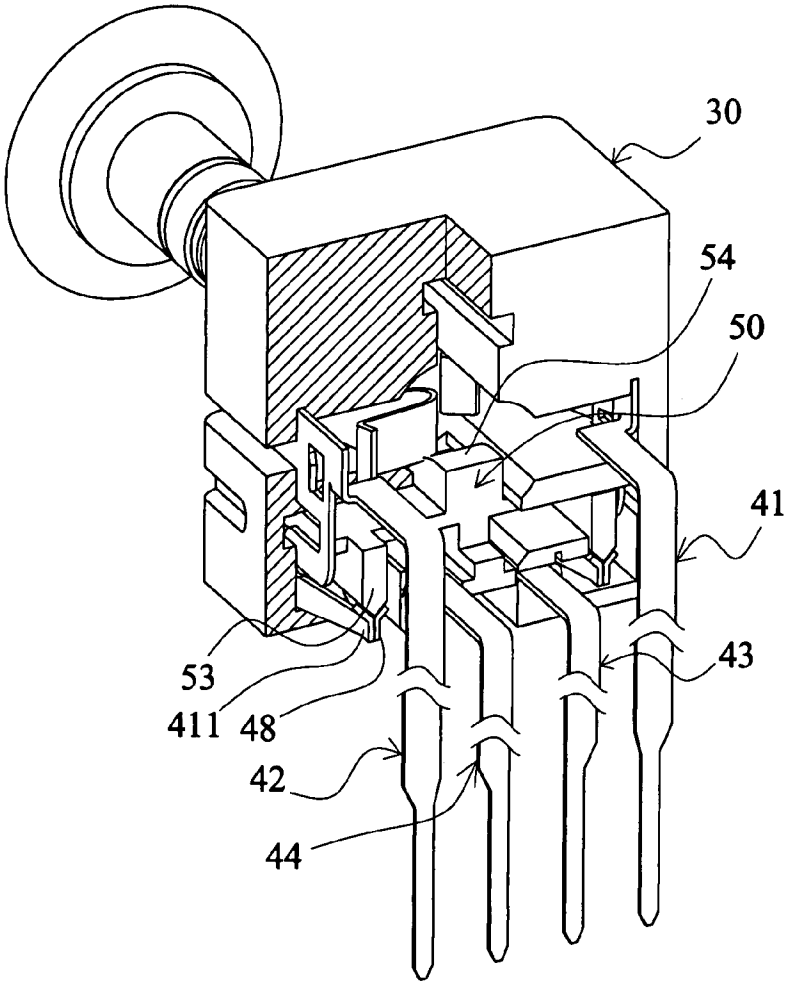
FIG. 16 is a pictorially assembled view showing the fourth embodiment of the invention.

As shown in FIGS. 15 and 16, the fourth embodiment is almost the same as the first embodiment except that the four terminals include first and second terminals 41 and 42 electrically connected to the signal wire and third and fourth terminals 43 and 44 electrically connected to the first and second terminals 41 and 42 to form loops. Each of the first and second terminals further has a second elastic arm 410 under the elastic arm 47. The plate faces of the second elastic arms 410 of the first and second terminals are longitudinal and located in the chamber 32 of the plastic base, and formed with second contacts 411, which can be moved laterally and elastically contact the contacts 48 of the third and fourth terminals 43 and 44, respectively. One end of the insulation block 50 is formed with a pivot 51. The middle of the insulation block 50 is formed with a projection 54 extending upward. The projection 54 is formed with a contact slant 52. Two sides of the insulation block 50 are formed with longitudinal blocking members 53 extending downward. The blocking members 53 are respectively located above the second contact 411 of the first terminal 41 and the contact 48 of the third terminal 43, and above the second contact 411 of the second terminal 42 and the contact 48 of the fourth terminal 44.

Figure 17:
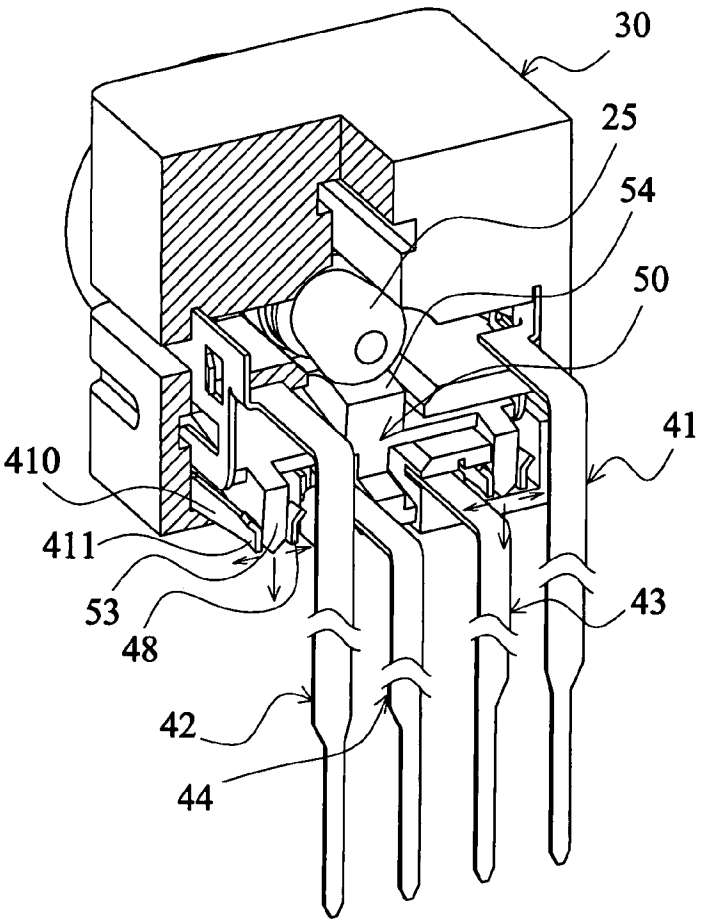
FIG. 17 is a pictorial view showing the usage state according to the fourth embodiment of the invention.

As shown in FIG. 16, when the plug 25 is not inserted into the hole 31, the second contact 411 of the first terminal 41 contacts the contact 48 of the third terminal 43 to form a loop, and the second contact 411 of the first terminal 41 contacts the contact 48 of the fourth terminal 44 to form a loop. As shown in FIG. 17, when the plug 25 is inserted into the hole 31, the plug 25 is electrically connected to the contacts 48 of the first and second terminals 41 and 42 while pushing the contact slant 52 of the insulation block 50 such that the insulation block 50 is moved downward. Thus, the two blocking members 53 respectively separate the second contact 411 of the first terminal 41 from the contact 48 of the third terminal 43, and the second contact 411 of the second terminal 42 from the contact 48 of the fourth terminal 44.

Figure 18:
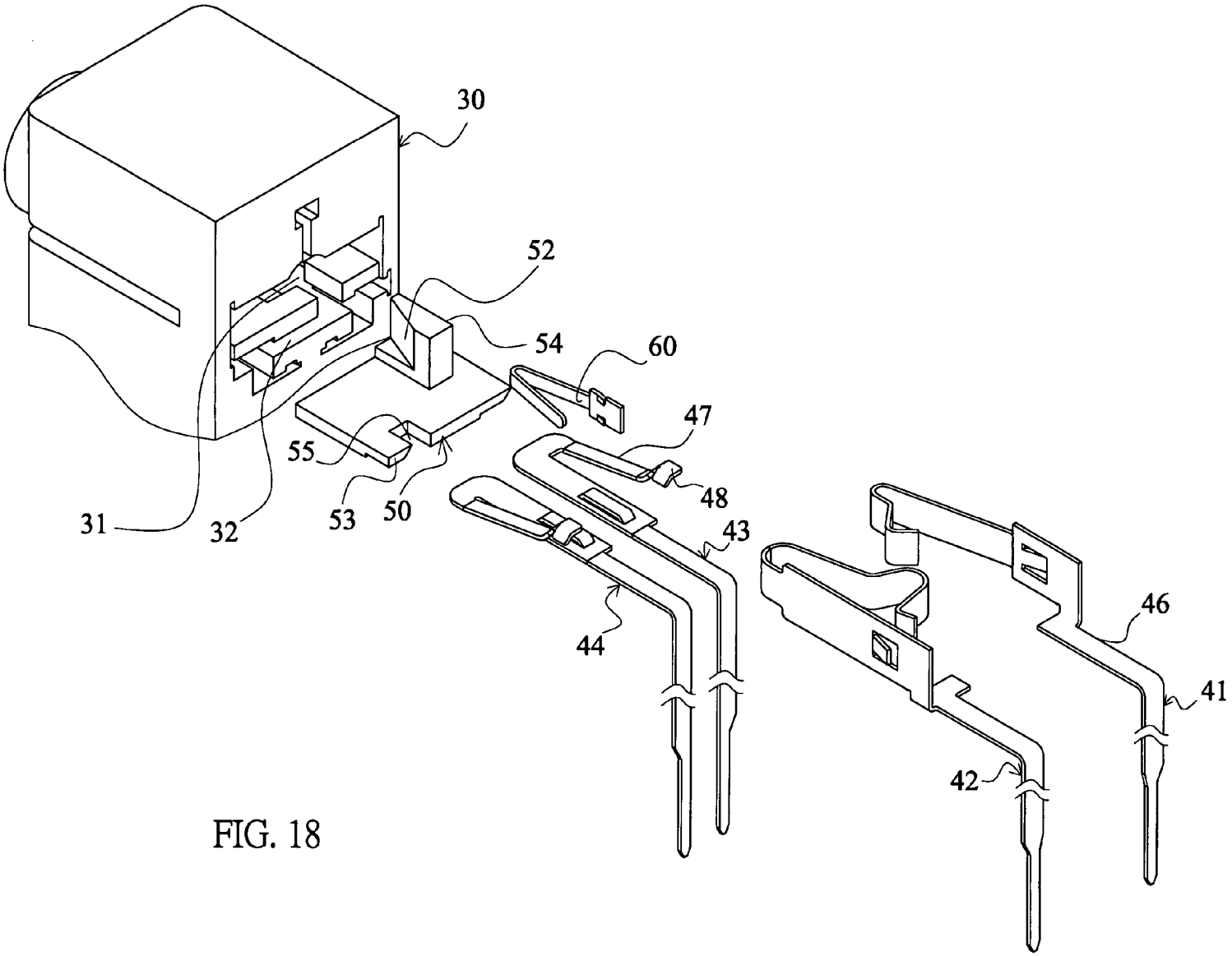
FIG. 18 is a pictorially exploded view showing a fifth embodiment of the invention.
Figure 19:
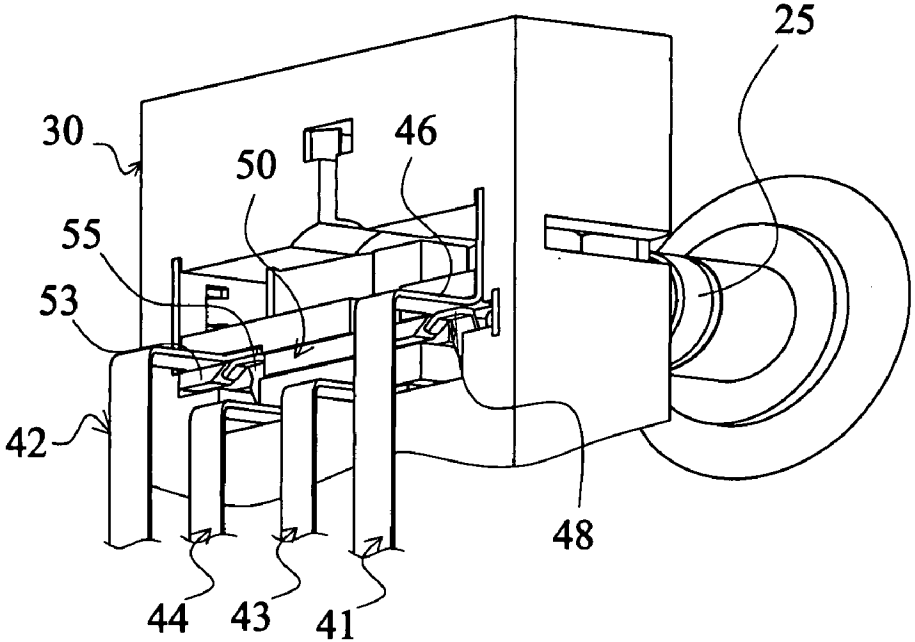
FIG. 19 is a pictorially assembled view showing the fifth embodiment of the invention.

As shown in FIGS. 18 and 19, the fifth embodiment is almost the same as the fourth embodiment except that the insulation block 50 is moved laterally, the plate faces of the elastic arms 47 of the third and fourth terminals 43 and 44 are horizontal, and the contacts 48 of the third and fourth terminals 43 and 44 are moved in a vertical direction and elastically contact the transversal portions 46 of the first and second terminals 41 and 42, respectively. The insulation block 50 may be moved laterally in the plastic base and is formed with a horizontal blocking member 53 and a longitudinal projection 54. The blocking member 53 is disposed in the chamber 32 and clamped between the transversal portion 46 of the first terminal 41 and the contact 48 of the third terminal 43, and between the transversal portion 46 of the second terminal 42 and the contact 48 of the fourth terminal 44. The blocking member 53 is formed with a notch 55. The projection 54 extends into the hole 31 and a contact slant 52 is formed on one side of the projection 54.

Figure 20:
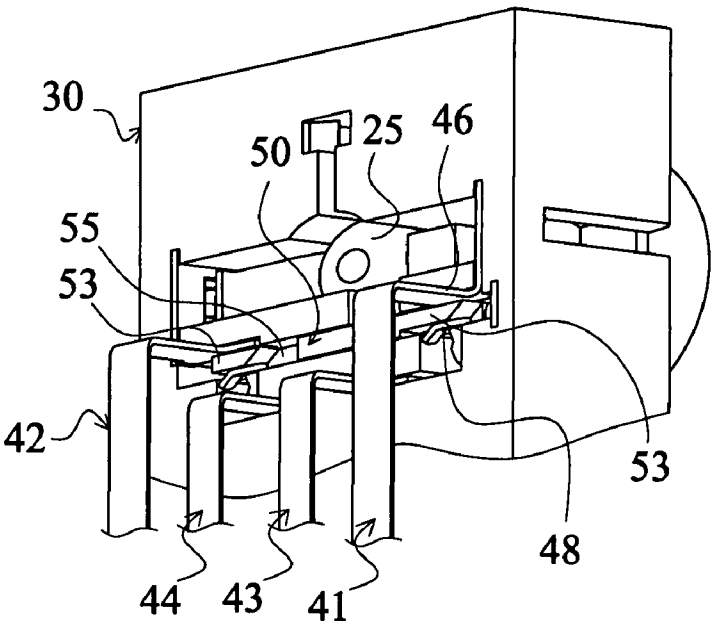
FIG. 20 is a pictorial view showing the usage state according to the fifth embodiment of the invention.

As shown in FIG. 19, when the plug 25 is not inserted into the hole 31, the transversal portion 46 of the first terminal 41 elastically contacts the contact 48 of the third terminal 43 to form electrical connection therebetween. In addition, the transversal portion 46 of the second terminal 42 and the contact 48 of the fourth terminal 44 are just located in the notch 55 of the blocking member 53 of the insulation block 50, so the transversal portion 46 and the contact 48 also contact each other to form the electrical connection. As shown in FIG. 20, when the plug 25 is inserted into the hole 31, the plug 25 is electrically connected to the first and second terminals 41 and 42 while pushing the contact slant 52 of the insulation block 50 such that the insulation block 50 is moved toward a side. So, the blocking member 53 separates the transversal portion 46 of the first terminal 41 from the contact 48 of the third terminal 43 to make the two terminals OFF. Similarly, the blocking member 53 also separates the transversal portion 46 of the second terminal 42 from the contact 48 of the fourth terminal 44 to make the two terminals OFF.

Figure 21:
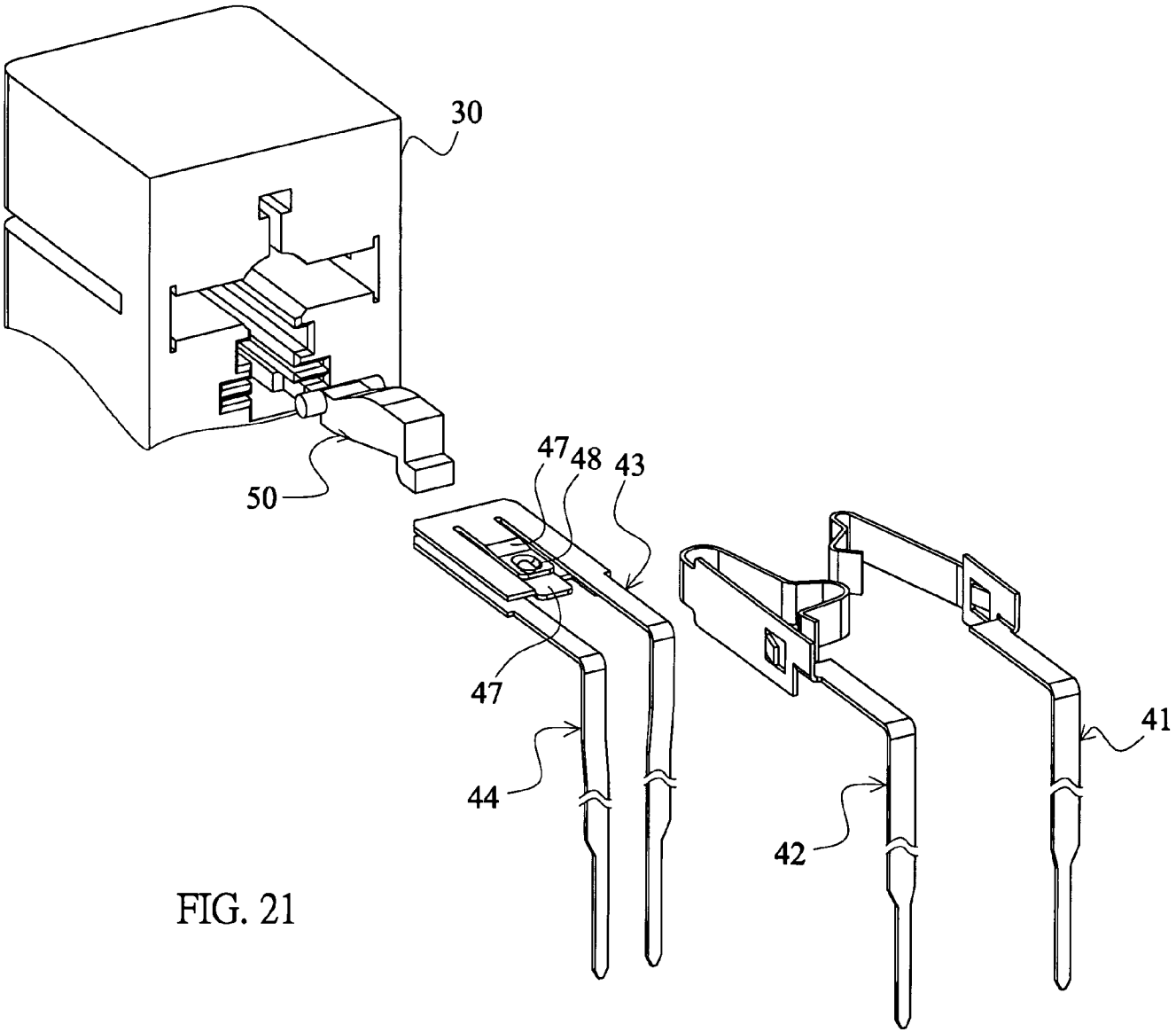
FIG. 21 is a pictorially exploded view showing a sixth embodiment of the invention.
Figure 22:
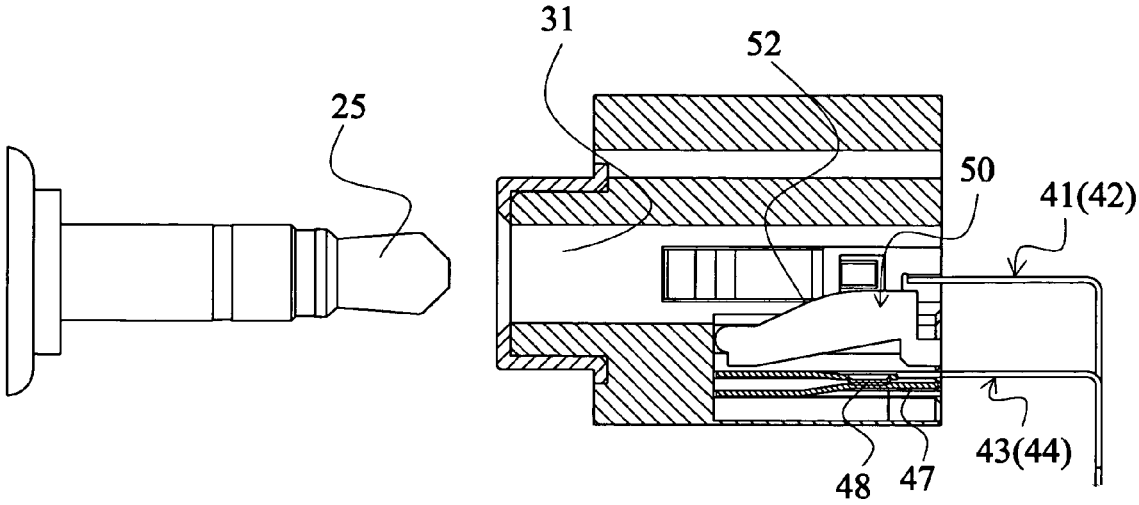
FIG. 22 is an assembled cross-sectional view showing the sixth embodiment of the invention.

As shown in FIGS. 21 and 22, the sixth embodiment is almost the same as the second embodiment except that the plate faces of the elastic arms 47 of the third and fourth terminals 43 and 44 are horizontal and elastically contact each other when the plug 25 is not inserted. The elastic arm 47 of the third terminal 43 is located above the elastic arm 47 of the fourth terminal 44, and the insulation block 50 rests against the elastic arm 47 of the fourth terminal 44.

Figure 23:
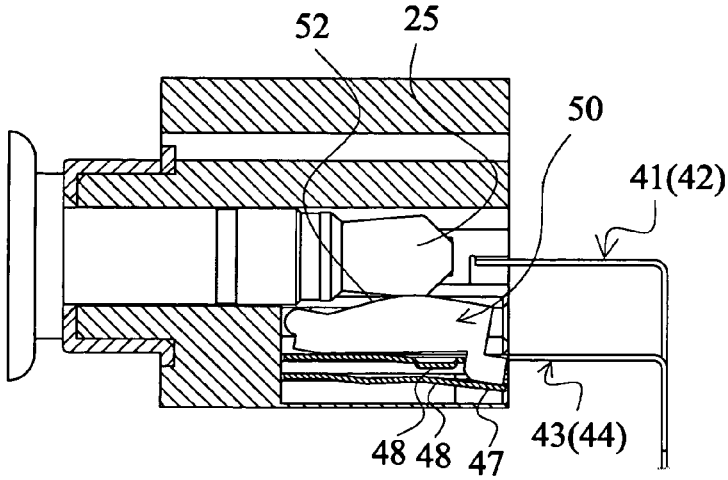
FIG. 23 is a cross-sectional view showing the usage state according to the sixth embodiment of the invention.

As shown in FIG. 23, when the plug 25 is inserted into the hole 31, the plug 25 is electrically connected to the contacts 48 of the first and second terminals 41 and 42 while pushing the contact slant 52 of the insulation block 50, such that the insulation block 50 is moved downward to press the elastic arm 47 of the fourth terminal 44 and thus separates the contacts 48 of the third and fourth terminals 43 and 44 from each other.

This embodiment is designed according to special needs, so the operation thereof is just contrary to that of the second embodiment.

The invention has the following advantages.

1. The invention has a movable insulation block to separate the plug 25 from each of the first and second terminals 41 and 42, so the manufacturing processes are simpler and the manufacturing cost may be reduced.

2. The insulation block 50 has the blocking member 53 to clamp the contact 48 of the terminal and prevent the contact 48 from exposing to the air and oxidizing. In addition, the moving insulation block 50 can rub against the contact 48 of the terminal and thus remove the oxidation layer on the contact 48.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connection socket structure, into which a plug of a signal wire is inserted for electrical connection, the structure comprising:

a plastic base formed with a hole;

a plurality of terminals disposed in the plastic base, wherein each of the plurality of terminals has a pin and an elastic arm, the pin is located below the plastic base and the elastic arm has a contact; and an insulation block, which is in direct contact with the plastic base, disposed in the plastic base and formed with a contact slant, wherein when the plug is inserted into the hole of the plastic base, the plug pushes the contact slant of the insulation block and thus moves the insulation block, and at least two terminals among the plurality of terminals may be electrically connected to or disconnected from each other according to a displacement of the insulation block.

2. The structure according to claim 1, wherein:

the plurality of terminals comprises a first terminal and a second terminal, which are electrically connected to the signal wire, and a third terminal and a fourth terminal, which form a switch device;

when the plug is not inserted into the hole, the contact of the third terminal does not contact the contact of the fourth terminal; and when the plug is inserted into the hole, the plug is electrically connected to the first terminal and the second terminal and pushes the insulation block to move and make the contact of the third terminal be electrically connected to the contact of the fourth terminal.

3. The structure according to claim 2, wherein:

plate faces of the contacts of the third terminal and the fourth terminal are moved laterally and elastically contact each other;

the insulation block has a blocking member clamped between the contacts of the third terminal and the fourth terminal; and when the plug is inserted into the hole, the plug pushes the insulation block to move downward to separate the blocking member from the contacts of the third terminal and the fourth terminal, such that the contacts of the third terminal and the fourth terminal are electrically connected to each other.

4. The structure according to claim 1, wherein one end of the insulation block is pivoted on the plastic base, and the plug pushes the insulation block to move downward when the plug is inserted into the hole.

5. The structure according to claim 1, wherein:

the plurality of terminals comprises a first terminal and a second terminal, which are electrically connected to the signal wire, and a third terminal and a fourth terminal, which are electrically connected to the first terminal and the second terminal to form loops, respectively;

each of the first terminal and the second terminal further has a second contact to be in elastic contact with the contacts of the third terminal and the fourth terminal; and when the plug is inserted into the hole, the plug is electrically connected to the first terminal and the second terminal and pushes the insulation block to move to separate the contacts of the third terminal and the fourth terminal from the second contacts of the first terminal and the second terminals, respectively.

6. The structure according to claim 1, wherein an elastic member for providing a restoring force after the insulation block is pressed and moved is disposed in the plastic base.

7. The structure according to claim 2, wherein:

the contacts of the third terminal and the fourth terminal are moved in a vertical direction and elastically contact each other;

the insulation block has a blocking member clamped between the contacts of the third terminal and the fourth terminal; and when the plug is inserted into the hole, the plug pushes the insulation block to move laterally to separate the blocking member from the contacts of the third terminal and the fourth terminal such that the contacts of the third terminal and the fourth terminal are electrically connected to each other.

8. The structure according to claim 2, wherein one end of the insulation block is pivoted on the plastic base, and the plug pushes the insulation block to move downward when the plug is inserted into the hole.

9. The structure according to claim 5, wherein:

the insulation block has two blocking members; and when the plug is inserted into the hole, the plug pushes the insulation block to move such that the two blocking members are clamped between the second contact of the first terminal and the contact of the third terminal, and between the second contact of the second terminal and the contact of the fourth terminal.

10. The structure according to claim 9, wherein one end of the insulation block is pivoted on a sidewall of the plastic base, and the plug pushes the insulation block to move downward when the plug is inserted into the hole.

11. The structure according to claim 5, wherein one end of the insulation block is pivoted on a sidewall of the plastic base, and the plug pushes the insulation block to move downward when the plug is inserted into the hole.

12. The structure according to claim 2, wherein the contacts of the third terminal and the fourth terminal are moved vertically to elastically contact each other, and the insulation block rests against the elastic arm of the third terminal.

* * * * *